US009850785B2

(12) United States Patent
Berruet et al.

(10) Patent No.: US 9,850,785 B2
(45) Date of Patent: Dec. 26, 2017

(54) CAM FOLLOWER AND METHOD FOR MANUFACTURING SUCH A CAM FOLLOWER

(71) Applicants: Nicolas Berruet, Artannes sur Indre (FR); François Champalou, Chaumont-sur-Loire (FR); Richard Corbett, Fondettes (FR); Benoît Hauvespre, Saint Etienne de Chigny (FR); Guillaume Jouanno, Plouha (FR); Samuel Viault, Saint-Antoine-du-Rocher (FR)

(72) Inventors: Nicolas Berruet, Artannes sur Indre (FR); François Champalou, Chaumont-sur-Loire (FR); Richard Corbett, Fondettes (FR); Benoît Hauvespre, Saint Etienne de Chigny (FR); Guillaume Jouanno, Plouha (FR); Samuel Viault, Saint-Antoine-du-Rocher (FR)

(73) Assignee: AKTIEBOLAGET SKF, Gothenburg (SE)

( * ) Notice: Subject to any disclaimer, the term of this patent is extended or adjusted under 35 U.S.C. 154(b) by 60 days.

(21) Appl. No.: 15/005,301

(22) Filed: Jan. 25, 2016

(65) Prior Publication Data

US 2016/0230610 A1 Aug. 11, 2016

(30) Foreign Application Priority Data

Feb. 5, 2015 (EP) ..... 15305170

(51) Int. Cl.

| | |
|---|---|
| ***F01L 1/14*** | (2006.01) |
| ***F02M 59/10*** | (2006.01) |
| ***F04B 1/04*** | (2006.01) |

(52) U.S. Cl.

CPC ..... *F01L 1/14* (2013.01); *F02M 59/102* (2013.01); *F04B 1/0417* (2013.01); (Continued)

(58) Field of Classification Search

CPC ..... F01L 1/13; F01L 2105/02; F01L 2103/00; F01L 1/14; F01L 2107/00; F01L 2810/02; F02M 59/102; F04B 1/0426; F04B 1/0417

See application file for complete search history.

(56) References Cited

U.S. PATENT DOCUMENTS

2013/0213333 A1 8/2013 Dorn et al.

FOREIGN PATENT DOCUMENTS

| | | | |
|---|---|---|---|
| DE | 2941495 | A1 | 5/1980 |
| EP | 615056 | A1 | 9/1994 |
| WO | 14048421 | A1 | 4/2014 |

*Primary Examiner* — Zelalem Eshete

(74) *Attorney, Agent, or Firm* — Bryan Peckjian; SKF USA Inc. Patent Dept.

(57) ABSTRACT

A cam follower, comprising: a tappet which includes two flanges provided with opposite holes centered on a transverse axis; a pin extending along the transverse axis between two opposite ends received in the opposite holes; and a roller movable in rotation relative to the pin around the transverse axis and adapted to roll on a cam. Each of the opposite holes is provided with: an open portion for mounting the pin by translation in a first direction perpendicular to the transverse axis, a cylindrical portion for supporting the pin along the first direction and a plane portion for retaining the pin along the transverse axis during transport and mounting of the cam follower. A method includes steps for manufacturing such a cam follower.

12 Claims, 3 Drawing Sheets

(52) U.S. Cl.
CPC ..... *F04B 1/0426* (2013.01); *F01L 2103/00* (2013.01); *F01L 2105/02* (2013.01); *F01L 2107/00* (2013.01); *F01L 2810/02* (2013.01)

CAM FOLLOWER AND METHOD FOR MANUFACTURING SUCH A CAM FOLLOWER

CROSS REFERENCE TO RELATED APPLICATION

This is a Non-Provisional Patent Application, filed under the Paris Convention, claiming the benefit of European Patent (EP) Patent Application Number 15305170.1, filed on 5 Feb. 2015 (05.02.2015), which is incorporated herein by reference in its entirety.

TECHNICAL FIELD OF THE INVENTION

The invention concerns a cam follower. The invention also concerns an injection pump or a valve actuator comprising such a mechanical system. The invention also concerns a method for manufacturing such a cam follower.

BACKGROUND OF THE INVENTION

EP-A-2 607 636 discloses an example of cam follower, comprising a tappet, a pin and a roller. The tappet extends along a longitudinal axis, while the pin and the roller are centered on a transverse axis. The tappet is formed with two lateral flanges, delimiting an intermediate gap between them and each comprising a cylindrical bore. The roller is positioned in the intermediate gap, between both flanges and bores. The pin is fitted in the two bores, such that the roller is movable in rotation relative to the pin around its axis. The pin is then caulked, in other words plastically deformed, on both opposite ends to create a mechanical connection by press-fit in the tappet bores.

When the cam follower is in service, the roller collaborates with a cam synchronized with the internal combustion engine camshaft. The rotation of the camshaft leads to a periodic displacement of a piston of the pump that rests against the tappet, to allow fuel to be delivered. The tappet is movable back and forth along the longitudinal axis, while the roller is movable in rotation around its central axis.

In EP-A-2 607 636, the caulking operation allows to retain the pin along the transverse axis. The roller is positioned in the tappet, then the pin is inserted through the bores and the roller. Finally, the pin ends are caulked by press-fit in the bores. Thus, the pin is secured relative to the tappet, both in rotation and in translation.

Alternatively, it is known to implement caulking on the tappet, such that the pin is partly movable relative to this tappet. The pin can rotate around the transverse axis. Besides, the pin can move on a small distance along the transverse axis, but cannot be removed from the tappet.

However, caulking processes are difficult to control and require powerful machines.

JP-A-2013/029027 discloses another example of cam follower. The tappet comprises two flanges including holes for receiving the end of the pin. However, due to their particular shapes, the flanges are difficult to mold. Moreover, due to limited access for the tool, the holes are difficult to shape by machining. Moreover, the flanges must be deformed in order to insert the pin into the holes.

SUMMARY OF THE INVENTION

The aim of the invention is to provide a cam follower overcoming the disadvantages mentioned here-above.

To this end, the invention concerns a cam follower, comprising: a tappet which includes two flanges provided with opposite holes centered on a transverse axis; a pin extending along the transverse axis between two opposite ends received in the opposite holes; and a roller movable in rotation relative to the pin around the transverse axis and adapted to roll on a cam.

According to the invention, each of the opposite holes is provided with: an open portion for mounting the pin by translation in a first direction perpendicular to the transverse axis, a cylindrical portion for supporting the pin along the first direction and a plane portion for retaining the pin along the transverse axis during transport and mounting of the cam follower.

Thanks to the invention, the sub-assembly including the pin and the roller is easier to mount into the tappet. Given that the flanges are machined but do not need to be deformed, specific treatments can be performed on the tappet, by example cementation then heat treatment.

According to further aspects of the invention which are advantageous but not compulsory, such a cam follower may incorporate one or several of the following features:

- The flanges are provided with secondary holes each open, on the one hand, along the transverse axis between the plane portion and an outer side of the tappet and, on the other hand, perpendicular to the transverse axis in a second direction opposite the first direction, the secondary holes allowing passage of a tool shank for machining the opposite holes in the tappet.
- The flanges are provided with deformed portions to prevent dismounting of the pin by translation in a second direction opposite the first direction.
- The pin is secured to the tappet in the opposite holes, the flanges having deformed portions in contact with the ends of the pin.
- The pin is partly movable in the opposite holes, the flanges having deformed portions devoid of contact with the ends of the pin.
- The pin is movable in rotation around the transverse axis in the opposite holes.
- The pin is partly movable in translation and is retained by the plane portions along the transverse axis in the opposite holes.
- The flanges have deformed portions formed on both sides of the secondary holes.

The invention also concerns an injection pump for a motor vehicle, comprising a mechanical system as mentioned here-above.

The invention also concerns a valve actuator for a motor vehicle, comprising a mechanical system as mentioned here-above.

The invention also concerns a method for manufacturing a cam follower as mentioned here-above. The method comprises a mounting step b) consisting in mounting the pin into the opposite holes by translation in the first direction, without deforming the flanges.

According to further aspects of the invention which are advantageous but not compulsory, such a cam follower may incorporate one or several of the following features:

- The method comprises a machining step a) consisting in machining the opposite holes in the flanges before the mounting step b).
- The method comprises a deforming step c) consisting in plastically deforming the flanges to prevent dismounting of the pin by translation in a second direction opposite the first direction after the mounting step b).

After the deforming step c), the flanges have deformed portions in contact with the ends of the pin, such that the pin is secured to the tappet in the opposite holes.

After the deforming step c), the flanges have deformed portions devoid of contact with the ends of the pin, such that the pin is partly movable in the opposite holes.

BRIEF DESCRIPTION OF THE DRAWINGS

The invention will now be explained in correspondence with the annexed figures, and as an illustrative example, without restricting the object of the invention. In the annexed figures.

DETAILED DESCRIPTION OF SOME EMBODIMENTS

Figure 1:
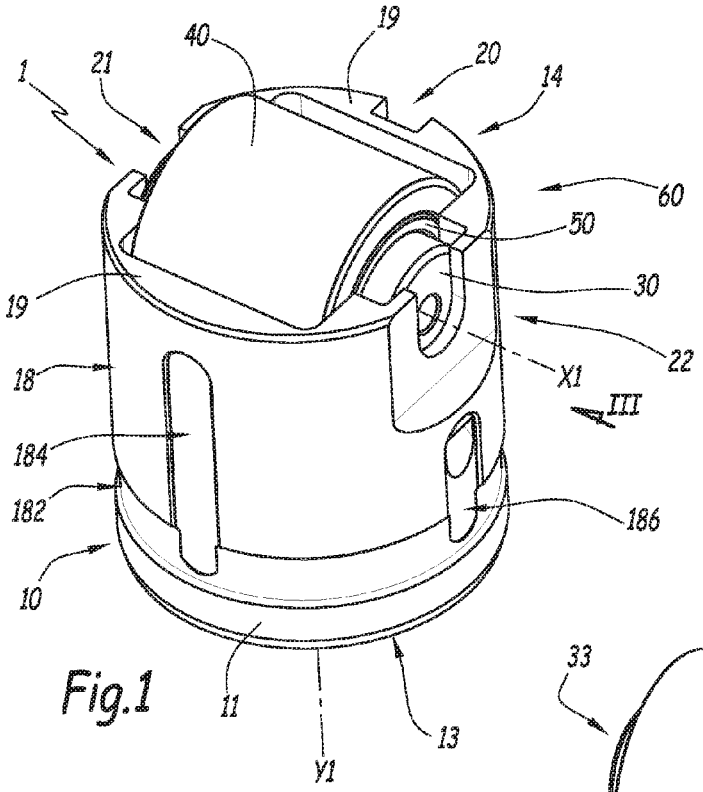
FIG. 1 is a perspective view of a cam follower according to the invention, comprising a tappet, a pin and a roller.
Figure 2:
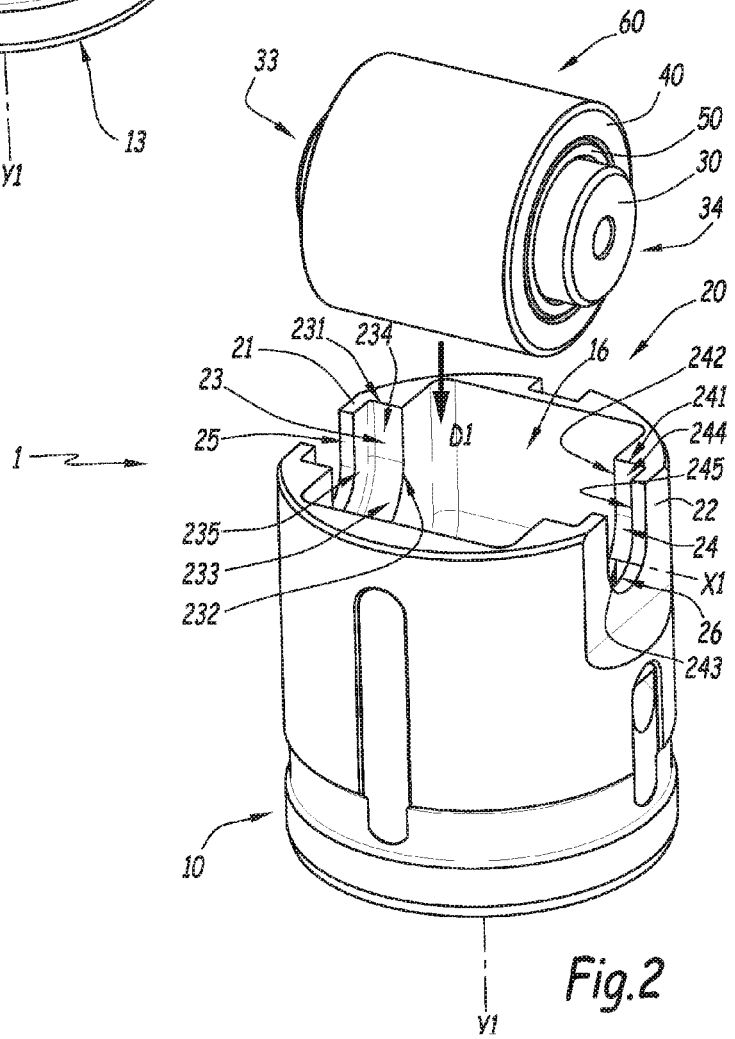
FIG. 2 is a perspective view similar to FIG. 1, before mounting of the pin and the roller on the tappet.
Figure 3:
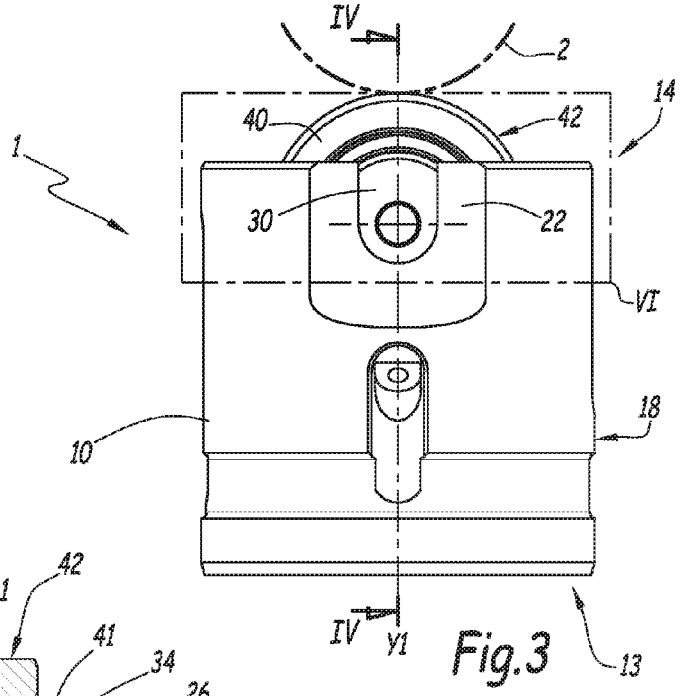
FIG. 3 is a side view along arrow III on FIG. 1.
Figure 4:
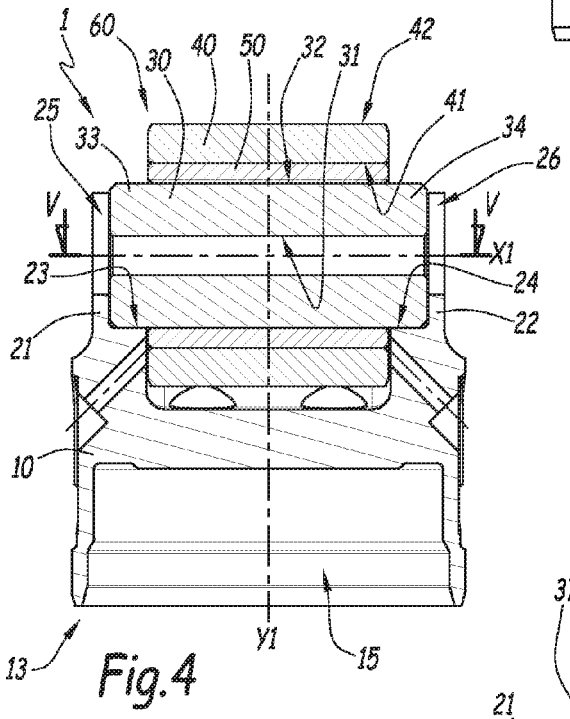
FIG. 4 is a sectional view along line IV-IV on FIG. 3.
Figure 5:
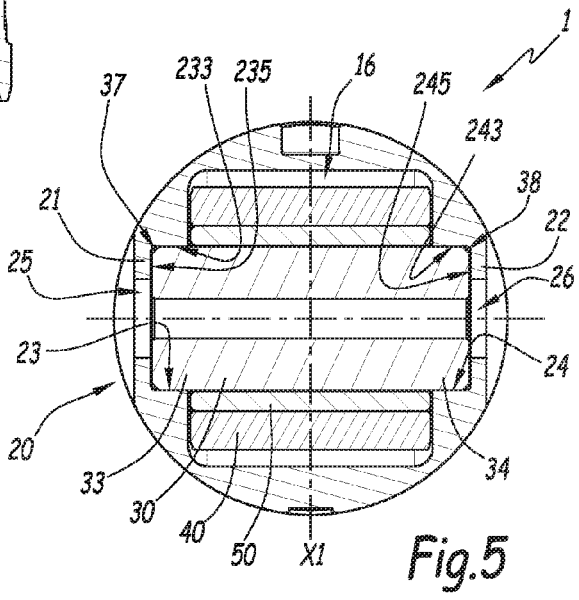
FIG. 5 is a sectional view along line V-V on FIG. 4.
Figure 6:
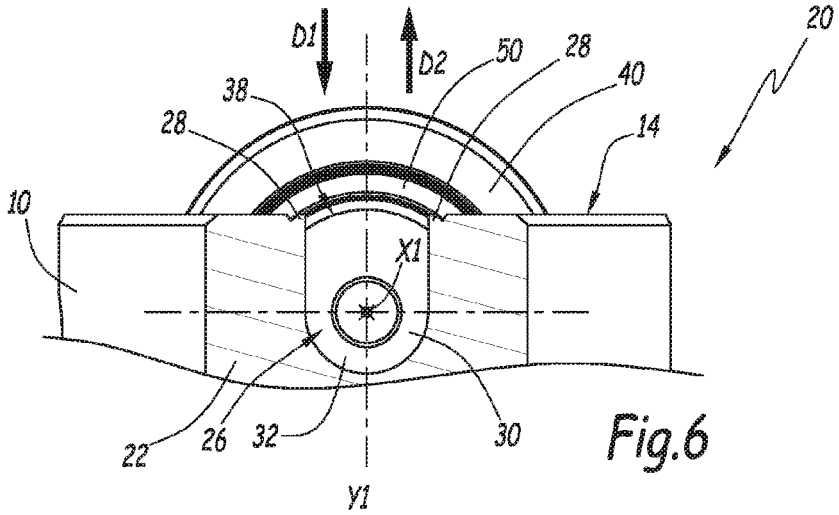
FIG. 6 is a view of detail VI on FIG. 3, at a larger scale and with a partial section, of the cam follower after localized caulking.
Figure 7:
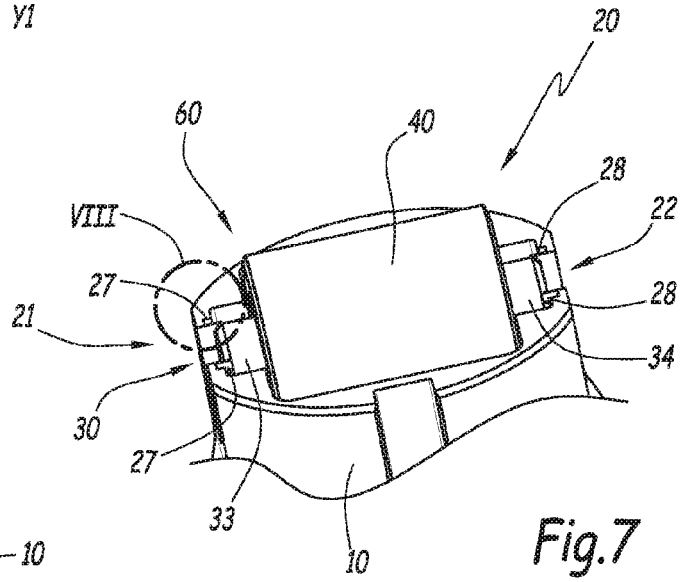
FIG. 7 is a partial perspective view, at a larger scale and from a different angle, of the cam follower of FIG. 1 after localized caulking.
Figure 8:
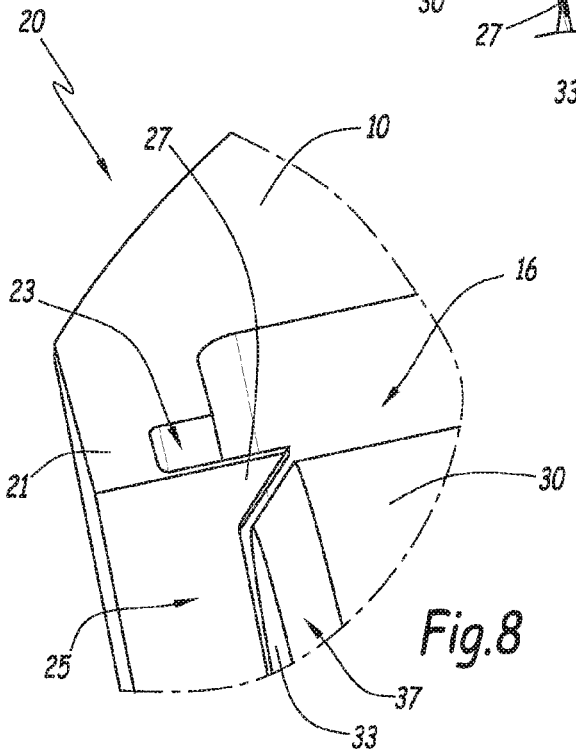
FIG. 8 is a view of detail VIII on FIG. 7, at a larger scale.

The cam follower 1 represented on FIGS. 1 to 8 is adapted to equip an injection pump or a valve actuator for a motor vehicle, not shown.

Cam follower 1 comprises a tappet 10, a pin 30, a roller 40 and a bearing 50. Elements 30, 40 and 50 are centered on a transverse axis X1 and form a roller sub-assembly 60. Tappet 10 is centered on a longitudinal axis Y1. Axes X1 and Y1 are perpendicular. Roller 40 is adapted to roll on a cam 2, partly shown on FIG. 3.

Tappet 10 comprises a cylindrical body 11 centered on axis Y1 and extending between opposite ends 13 and 14. Tappet 10 also comprises a transverse central portion 12 extending radially to axis Y1 and delimiting two cavities 15 and 16 inside body 11. Cavity 15 is open at end 13, has a cylindrical shape and receives a shaft or plunger, not shown, for moving tappet 10 along axis Y1. Cavity 16 is open at end 14, has a generally parallelepiped shape and partly receives sub-assembly 60. Body 11 has a cylindrical outer surface 18 centered on axis Y1 and extending between ends 13 and 14. Body 11 includes several recesses 182, 184 and 186, open at surface 18 and provided for lubrication or other functions that are not subjects of the present invention.

Tappet 10 is movable back and forth along axis Y1, in a non-represented bore belonging to the injection pump, with surface 18 sliding in this bore. Tappet 10 can be made of synthetic material, by example polyamide 6.6 (PA) or polyether-ether-ketone (PEEK), or made of metal, by example steel.

Furthermore, tappet 10 forms a support element for sub-assembly 60. Specifically, tappet 10 comprises a bearing portion 20 formed in body 11 and delimiting cavity 16 near end 14. Bearing portion 20 is adapted to receive pin 30, on which roller 40 and bearing 50 are mounted. To this end, bearing portion 20 comprises two lateral flanges 21 and 22 extending perpendicular to axis X1 and parallel to axis Y1, on both side of axis Y1. Flanges 21 and 22 are connected around axis Y1 by portions 19 of body 11. Each flange 21 and 22 includes an opening or hole, respectively 23 and 24, for receiving ends 33 and 34 of pin 30. Each flange 21 and 22 also includes a secondary opening or hole, respectively 25 and 26, in communication with holes 23 and 24. Each hole 25 and 26 allows the passage of a tool shank for machining corresponding hole 23 or 24. Holes 23, 24, 25 and 26 are formed by molding tappet 10, then holes 23 and 24 are machined to their final shape.

Each hole 23 and 24 is open at end 14 of tappet 10, inside cavity 16, and in corresponding hole 25 or 26. Hole 23 has an open portion 231 at end 14, so that pin 30 can be mounted in hole 23 by translation in a first direction D1 perpendicular to axis X1 and parallel to axis Y1, passing through portion 231. Hole 23 has an open portion 232 in communication with cavity 16, so that pin 30 positioned in hole 23 extends through cavity 16. Hole 23 has a cylindrical portion 233 for supporting end 33 of pin 30 along direction D1. More precisely, portion 233 is a half-cylindrical portion centered on axis X1 and formed opposite open portion 231 relative to axis X1. Hole 23 has two plane portions 234 extending parallel to each other from portion 233 up to portion 231. Hole 23 has a plane portion 235 for retaining pin 30 along axis X1 during transport and mounting of cam follower 1. Portion 235 extends perpendicular to axis X1, facing opposite hole 24. Similarly, hole 24 is provided with portions 241, 242, 243, 244 and 245, having reference numbers increased by ten. Each hole 25 and 26 is open, on the one hand, along axis X1 between plane portion 235 or 245 and the outer side of flange 21 or 22 and, on the other hand, perpendicular to axis X1 in a second direction D2 opposite direction D1.

Pin 30 comprises an inner cylindrical bore 41 and an outer cylindrical surface 42 centered on axis X1. Pin 30 extends along axis X1 between two pin ends 33 and 34 mounted in holes 23 and 24. Pin 30 is made of metal, such as steel or bronze. Roller 40 has an inner cylindrical bore 41 and an outer cylindrical surface 41 centered on axis X1. Surface 42 is intended to bear against the outer surface of cam 2 synchronized with the internal combustion engine camshaft. Bearing 50 is a bushing interposed between surface 32 of pin 30 and surface 41 of roller 40. Alternately, bearing 50 may be a rolling bearing including needles or cylindrical rollers.

The method for manufacturing cam follower 1 is detailed here-after.

The method comprises a molding step consisting in molding tappet 10. The method comprises steps of fabricating and assembling pin 30, roller 40 and bearing 50, to obtain roller sub-assembly 60.

When tappet 10 is molded, the method comprises a machining step a) consisting in machining holes 23 and 24 in flanges 21 and 22. Holes 25 and 26 allow passage of a tool shank. Holes 23 and 24 are machined to their final shape by a tool such as a reamer.

After the machining step a), the method comprises a mounting step b) consisting in mounting sub-assembly 60 into holes 23 and 24 by translation in direction D1, without deforming flanges 21 and 22. Ends 33 and 34 of pin 30 pass through open portions 231 and 241 and are received in holes 23 and 24, in contact with cylindrical portions 233 and 235. Thus, sub-assembly 60 is retained in translation relative to tappet 10 in direction D1.

After the mounting step b), the method comprises a deforming step c) consisting in plastically deforming flanges 21 and 22 to prevent dismounting of the pin 30 by translation in a direction D2 opposite direction D1. Preferably, the deforming step c) consists in caulking flanges 21 and 22.

Alternately, the deforming step c) can implement a plastic deformation process different from caulking, by example crimping or punching. As shown on the example of FIGS. 6 to 8, the flanges 21 and 22 are provided with caulked portions 27 and 28 formed on both sides of holes 25 and 26, near open portions 231 and 241 of holes 23 and 24. Preferably, ends 33 and 34 of pin 30 are provided with chamfers 37 and 38. Portions 27 and 28 are outstretched over chamfers 37 and 38, so that ends 33 and 34 are blocked in holes 23 and 24 and cannot be accidentally removed by translation in direction D2, in particular during transport of cam follower 1.

According to a first embodiment of the deforming step c), caulked portions 27 and 28 expanded in contact with ends 33 and 34 of pin 30, such that pin 30 is secured to tappet 10 in holes 23 and 24.

According to a second embodiment of the deforming step c), caulked portions 27 and 28 are expanded without contact with ends 33 and 34 of pin 30, such that pin 30 is partly movable in holes 23 and 24. In this case, pin 30 is movable in rotation around axis X1 and/or partly movable in translation along axis X1. However, pin 30 is retained in opposite holes 23 and 24 along axis X1 by plane portions 235 and 245. Moreover, pin 30 cannot be accidentally from removed holes 23 and 24 by translation in direction D2.

When manufacturing of cam follower 1 is complete, roller 40 is then adapted to roll, more precisely its surface 42 can roll, on an outer surface of cam 2. The load applied on surface 42 of roller 40 is transmitted to rolling bearing 50, then to pin 30, then to bearing portion 20 of tappet 10.

Other non-shown embodiments can be implemented within the scope of the invention.

According to a non-shown embodiment, body 11 is not provided with portions connecting 19 flanges 21 and 22 around axis Y1. Flanges 21 and 22 extend from portion 12 parallel to axis Y1 in a bifurcated manner, on both side of axis Y1.

According to another non-shown embodiment, flanges 21 and 22, holes 23, 24, 25 and 26, or deformed portions 27 and 28 may have different shapes, positions and/or dimensions.

Whatever the embodiment, each of the opposite holes 23 and 24 is provided with an open portion 231 or 241 for mounting pin 30 by translation in direction D1 perpendicular to axis X1, a cylindrical portion 233 or 243 for supporting pin 30 along direction D1 and a plane portion 235 or 245 for retaining pin 30 along axis X1 during transport and mounting of cam follower 1.

In addition, technical features of the different embodiments can be, in whole or part, combined with each other. Thus, the cam follower 1 and its manufacturing method can be adapted to the specific requirements of the application.

What is claimed is:

1. A cam follower, comprising:

a tappet which includes two flanges provided with opposite holes centered on a transverse axis;

a pin extending along the transverse axis between two opposite ends received in the opposite holes, wherein the two opposite ends each have a circular cross section as taken perpendicular to the transverse axis along a portion of the pin which contacts the two opposite holes; and a roller movable in rotation relative to the pin around the transverse axis and adapted to roll on a cam;

wherein each of the opposite holes is provided with:

an open portion for mounting the pin by translation in a first direction perpendicular to the transverse axis, a cylindrical portion for supporting the pin along the first direction and a plane portion for retaining the pin along the transverse axis during transport and mounting of the cam follower.

2. The cam follower according to claim 1, the flanges further comprising secondary holes, each secondary hole being open along the transverse axis between the plane portion and an outer side of the tappet, and each secondary hole being perpendicular to the transverse axis in a second direction, the second direction being opposite the first direction, the secondary holes allowing passage of a tool shank for machining the opposite holes in the tappet.

3. The cam follower according to claim 1, the flanges further comprising deformed portions to prevent dismounting of the pin by translation in a second direction opposite the first direction.

4. The cam follower according to claim 1, wherein the pin is secured to the tappet in the opposite holes, the flanges further comprising deformed portions in contact with the ends of the pin.

5. The cam follower according to claim 2, the flanges further comprising deformed portions formed on both sides of the secondary holes.

6. The cam follower according to claim 1, wherein the cam follower is integrated into an injection pump for a motor vehicle.

7. The cam follower according to claim 1, wherein the cam follower is integrated into a valve actuator for a motor vehicle.

8. A cam follower, comprising:

a tappet which includes two flanges provided with opposite holes centered on a transverse axis;

a pin extending along the transverse axis between two opposite ends received in the opposite holes; and a roller movable in rotation relative to the pin around the transverse axis and adapted to roll on a cam;

wherein each of the opposite holes is provided with:

an open portion for mounting the pin by translation in a first direction perpendicular to the transverse axis, a cylindrical portion for supporting the pin along the first direction and a plane portion for retaining the pin along the transverse axis during transport and mounting of the cam follower, wherein the pin is partly movable in the opposite holes, the flanges further comprising deformed portions devoid of contact with the ends of the pin.

9. The cam follower according to claim 8, wherein the pin is movable in rotation around the transverse axis in the opposite holes.

10. The cam follower according to claim 8, wherein the pin is partly movable in translation and is retained by the plane portions along the transverse axis in the opposite holes.

11. A method for manufacturing a cam follower, the cam follower comprising:

a tappet which includes two flanges provided with opposite holes centered on a transverse axis;

a pin extending along the transverse axis between two opposite ends received in the opposite holes; and a roller movable in rotation relative to the pin around the transverse axis and adapted to roll on a cam;

wherein each of the opposite holes is provided with:

an open portion for mounting the pin by translation in a first direction perpendicular to the transverse axis, a cylindrical portion for supporting the pin along the first direction and a plane portion for retaining the pin along the transverse axis during transport and mounting of the cam follower, the method comprising a mounting step, the mounting step comprising a step of:

wherein the machining step is accomplished following the mounting step mounting the pin into the opposite holes by translation in the first direction, without deforming the flanges plastically deforming the flanges to prevent dismounting of the pin by translation in a second direction opposite the first direction, wherein the plastically deforming step is accomplished following the mounting step, plastically deforming the flanges to prevent dismounting of the pin by translation in a second direction opposite the first direction, wherein the deformed portions of the flange are devoid of contact with the ends of the pin, such that the pin is partly movable in the opposite holes.

12. The method according to claim 11, further comprising a machining step, the machining step comprising a step of:

machining the opposite holes in the flanges, wherein the machining step is accomplished prior to the mounting step.

* * * * *